US005883062A

United States Patent [19]

Addison et al.

[11] Patent Number: 5,883,062

[45] Date of Patent: Mar. 16, 1999

[54] MANUAL DISHWASHING COMPOSITIONS

[75] Inventors: Michael Crombie Addison; Peter Robert Foley, both of Newcastle upon Tyne; Andrew Micheal Allsebrook, Bolton, all of United Kingdom

[73] Assignee: The Procter & Gamble Company

[21] Appl. No.: 605,125

[22] PCT Filed: Sep. 1, 1994

[86] PCT No.: PCT/US94/09890

§ 371 Date: Dec. 20, 1996

§ 102(e) Date: Dec. 20, 1996

[87] PCT Pub. No.: WO95/07969

PCT Pub. Date: Mar. 23, 1995

[30] Foreign Application Priority Data

Sep. 14, 1993 [EP] European Pat. Off. ..... 93307238

[51] Int. Cl.[6] ..... C11D 1/12

[52] U.S. Cl. ..... 510/235; 510/236; 510/233; 510/218; 510/426; 510/427; 510/428; 510/536

[58] Field of Search ..... 510/218, 235, 510/236, 237, 426, 427, 428, 536

[56] References Cited

U.S. PATENT DOCUMENTS

| | | | |
|---|---|---|---|
| 4,923,635 | 5/1990 | Simion et al. | 510/365 |
| 5,096,622 | 3/1992 | Simion et al. | 510/237 |
| 5,230,823 | 7/1993 | Wise et al. | 510/237 |
| 5,266,237 | 11/1993 | Freeman et al. | 252/542 |
| 5,269,974 | 12/1993 | Ofosu-Asante | 252/544 |
| 5,308,530 | 5/1994 | Aronson et al. | 252/174.12 |
| 5,320,783 | 6/1994 | Marin et al. | 252/544 |
| 5,338,491 | 8/1994 | Connor et al. | 242/548 |
| 5,346,641 | 9/1994 | Argo et al. | 252/163 |
| 5,376,310 | 12/1994 | Cripe et al. | 510/235 |
| 5,378,409 | 1/1995 | Ofosu-Asante | 510/235 |
| 5,393,468 | 2/1995 | Erilli et al. | 510/365 |
| 5,415,814 | 5/1995 | Ofosu-Asante | 510/235 |
| 5,417,893 | 5/1995 | Ofosu-Asante | 510/235 |
| 5,580,849 | 12/1996 | Dyet et al. | 510/427 |
| 5,599,400 | 2/1997 | Mao et al. | 135/25.2 |

*Primary Examiner*—Necholus Ogden
*Attorney, Agent, or Firm*—Ken K. Patel; Jacobus C. Rasser; Pankaj M. Khosla

[57] ABSTRACT

A detergent composition comprises from 1% to 80%, by weight, anionic surfactant and from 0.05% to 10%, by weight, divalent ion selected from the group consisting of magnesium ions, calcium ions, and mixtures thereof. The composition is formulated such that the pH of a 1% solution of the composition in water at 20° C. is between 3.5 and 4.5.

18 Claims, No Drawings

MANUAL DISHWASHING COMPOSITIONS

The formulator of a dishwashing detergent composition faces the challenge of deriving a formulation which meets a number of distinct consumer relevant performance demands.

Firstly, such a composition should be effective at removing soils from dirty "dishes" when used in a dishwashing process. The term "dishes" is used herein in a generic sense, and encompases essentially any items which may be found in a dishwashing load, including chinaware, glassware, plasticware, hollowware and cutlery, including silverware.

The soils encountered in dishwashing will largely but not exclusively be food based. Particularly difficult soils to remove would include greasy soils, burnt on food soils, dried on food soils, highly coloured soils derived from, e.g. highly coloured vegetables such as beetroot and tomato, as well as non-food soils such as lipstick on the rims of glasses or nicotine stains on saucers which have been used as ashtrays.

Manual dishwashing compositions are usually unbuilt, and may contain added levels of Ca and Mg to aid cleaning performance. Laundry and automatic dishwashing compositions typically contain high levels of builder. Hard-surface cleaner compositions whilst occasionally unbuilt, typically do not contain added Ca or Mg to boost performance.

Manual dishwashing compositions typically contain no bleaching components, which are by contrast common components of laundry, machine dishwashing and hard-surface cleaner compositions.

Manual dishwashing compositions are typically formulated to perform well at near neutral pH. Machine dishwashing, non-bleach containing hard surface cleaner compositions and laundry compositions are typically alkaline with a pH of usually 9–11. Bleach containing hard surface cleaner compositions are often acidic with a pH of less than 6.

A number of different washing methods are commonly used in manual dishwashing. Preferences as to method employed tend to reflect the geographic and cultural background of the person doing the washing-up.

One habit, commonly encountered in, for example, Northern Europe involves immersing the soiled dishes in a dilute solution of a dishwashing detergent composition, typically contained within a sink, and then rubbing the surface of the dishes with a cloth or sponge to remove soils, which are then taken into the wash solution.

Another habit, the direct application method, commonly encountered in Southern Europe, and Latin America, typically involves wetting the soiled dishes, followed by removing each dish from the water bath and rubbing its surface with a cloth or sponge soaked in, essentially, concentrated detergent product. The dish is then rinsed by immersion in a second water bath, or by being held in a stream of running water.

A further manual dishwashing habit, not commonly practised, involves contacting soiled dishes with a concentrated detergent product (e.g. using a spray dispenser), and allowing the product to remain on the surface of the dishes for a period of time. The dishes may subsequently be rinsed by immersion in a water bath or passing under a stream of running water, with optionally manual rubbing of the surface of the dishes with, e.g. a sponge or cloth, or using the rinse cycle of an automatic dishwashing machine. Alternatively, the dishes may be subjected to washing steps, utilising further detergent product, which may involve either a manual dishwashing method, or a washing method utilising an automatic dishwashing machine.

The Applicants have now discovered that a composition containing anionic surfactant and divalent cation (particularly Ca or Mg) having an acidic pH, gives remarkable performance benefits, particularly greasy cleaning performance benefits, when employed in a dishwashing method in which, essentially, concentrated detergent product is applied directly to the surface of the dishes, preferably followed by rinsing of the dishes.

SUMMARY OF THE INVENTION

There is provided a fluid detergent composition, suitable for use in a dishwashing method in which the detergent composition is applied to the dishes in essentially concentrated form, containing (a) from 1% to 80% by weight of the composition of anionic surfactant; and (b) from 0.05% to 10% by weight of divalent ion, selected from magnesium and calcium ions;

wherein said composition is formulated such that the pH of a 1% solution of the composition in water, at 20°, is no more than 6.

Preferably said composition is in the form of a liquid or a gel.

Preferably said composition contains organic solvent components.

Preferably said composition contains no builder salts.

Preferably said composition contains no bleaching components.

Preferably said composition contains additional surfactant selected from nonionic, cationic, zwitterionic, ampholytic and amphoteric surfactants.

Preferably a 1% by weight solution of said composition has a pH of from 3 to 6.

Said composition can be formulated to contain enzyme components.

DETAILED DESCRIPTION OF THE INVENTION

Anionic surfactant

The first essential component of the composition of the invention is anionic surfactant present at a level of from 1% to 80% by weight, preferably from 3% to 60% by weight, more preferably from 5% to 40% by weight of the composition.

The anionic surfactant may be, essentially any anionic surfactant, including anionic sulfate, sulfonate or carboxylate surfactant.

Anionic sulfate surfactant

The anionic sulfate surfactant may be any organic sulfate surfactant. It is preferably selected from the group consisting of $C_{10}$–$C_{16}$ alkyl sulfate which has been ethoxylated with an average of from 0.5 to 20 moles of ethylene oxide per molecule, $C_9$–$C_{17}$ acyl-N—(C1–C4 alkyl) glucamine sulfate and mixtures thereof.

Alkyl ethoxy sulfate surfactants suitable for use herein comprise a primary alkyl ethoxy sulfate derived from the condensation product of a $C_{10}$–$C_{16}$ alcohol with an average of from 0.5 to 20, preferably from 0.5 to 12, ethylene oxide groups. $C_{12}$–$C_{14}$ alkyl sulfate which has been ethoxylated with an average of from 0.5 to 4 moles of ethylene oxide per molecule is especially preferred.

The counterion for the anionic sulfate surfactant component is preferably selected from calcium, sodium, potassium, magnesium, ammonium, or alkanol-ammonium, and mixtures thereof, with calcium and magnesium being preferred for cleaning and sudsing, respectively.

Anionic sulfonate surfactant

Anionic sulfonate surfactants suitable for use herein include, for example, the salts (e.g. alkali metal salts) of $C_9$–$C_{20}$ linear alkylbenzene sulfonates, $C_8$–$C_{22}$ primary or secondary alkane sulfonates, $C_8$–$C_{24}$ olefin sulfonates, sulfonated polycarboxylic acids, alkyl glycerol sulfonates, fatty acyl glycerol sulfonates, fatty oleyl glycerol sulfonates, paraffin sulfonates, and any mixtures thereof.

Anionic alkyl ethoxy carboxylate surfactant

Alkyl ethoxy carboxylates suitable for use herein include those with the formula $RO(CH_2CH_2O)x\ CH_2COO—M^+$ wherein R is a $C_{12}$ to $C_{16}$ alkyl group, x ranges from 0 to 10, and the ethoxylate distribution is such that, on a weight basis, the amount of material where x is 0 is less than 20%, preferably less than 15%, most preferably less than 10%, and the amount of material where x is greater than 7, is less than 25%, preferably less than 15%, most preferably less than 10%, the average x is from 2 to 4 when the average R is $C_{13}$ or less, and the average x is from 3 to 6 when the average R is greater than $C_{13}$, and M is a cation, preferably chosen from alkali metal, alkaline earth metal, ammonium mono-, di-, and tri-ethanol-ammonium, most preferably from sodium, potassium, ammonium and mixtures thereof with magnesium ions. The preferred alkyl ethoxy carboxylates are those where R is a $C_{12}$ to $C_{14}$ alkyl group.

Anionic alkyl polyethoxy polycarboxylate surfactant

Alkyl polyethoxy polycarboxylate surfactants suitable for use herein include those having the formula:

$$R—O—(\underset{R_1}{CH}—\underset{R_2}{CH}—O)X—R3$$

wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Anionic secondary soap surfactant

Secondary soap surfactants (aka "alkyl carboxyl surfactants") useful herein are those which contain a carboxyl unit connected to a secondary carbon. It is to be understood herein that the secondary carbon can be in a ring structure, e.g. as in p-octyl benzoic acid, or as in alkyl-substituted cyclohexyl carboxylates. The secondary soap surfactants should contain no ether linkages, no ester linkages and no hydroxyl groups. There should be no nitrogen atoms in the head-group (amphiphilic portion). The secondary soap surfactants usually contain 11–13 total carbon atoms, although slightly more (e.g., up to 16) can be tolerated, e.g. p-octyl benzoic acid.

The following general structures further illustrate some of the secondary soap surfactants (or their precursor acids) useful herein.

A. A highly preferred class of secondary soaps useful herein comprises the secondary carboxyl materials of the formula $R^3\ CH(R^4)COOM$, wherein $R^3$ is $CH_3(CH_2)x$ and $R^4$ is $CH_3(CH_2)y$, wherein y can be O or an integer from 1 to 4, x is an integer from 4 to 10 and the sum of (x+y) is 6–10, preferably 7–9, most preferably 8.

B. Another class of secondary soaps useful herein comprises those carboxyl compounds wherein the carboxyl substituent is on a ring hydrocarbyl unit, i.e., secondary soaps of the formula $R^5$–$R^6$–COOM, wherein $R^5$ is $C^{7-C10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another class of secondary soaps comprises secondary carboxyl compounds of the formula $CH_3(CHR)_k—(CH_2)_m—(CHR)_n—CH(COOM)\ (CHR)_o—(CH2)_p—(CHR)_q—CH_3$, wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion, e.g., H, alkali metal, alkaline earth metal, ammonium, alkanolammonium, di- and tri-alkanolammonium, and $C_1$–$C_5$ alkyl substituted ammonium. Sodium is convenient, as is diethanolammonium.

Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Other anionic surfactants

Other anionic surfactants useful for detersive purposes can also be included in the compositions hereof. These can include salts (including, for example, sodium, potassium, ammonium, and substituted ammonium salts such as mono-, di- and triethanolamine salts) of soap, fatty oleyl glycerol sulfates, alkyl phenol ethylene oxide ether sulfates, alkyl phosphates, isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described herein), branched primary alkyl sulfates, alkyl polyethoxy carboxylates such as those of the formula $RO(CH_2CH_2O)_kC_2COO—M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Divalent Ions

The compositions of the invention contain as the second essential component divalent ion, selected from calcium and magnesium ions, at a level of from 0.05% to 10% by weight, preferably from 0.5% to 8% by weight, more preferably from 1% to 6% by weight, most preferably from 1.5% to 5% by weight of the composition.

Calcium

Preferably, from 0.05% to 5%, more preferably from 0.25% to 4% most preferably from 0.5% to 3% by weight of the composition of calcium ions may be included in the detergent compositions herein. It has additionally been found for compositions containing polyhydroxy fatty acid amide that the presence of calcium greatly improves the cleaning of greasy soils.

The calcium ions can, for example, be added as a chloride, hydroxide, oxide, formate or acetate, or nitrate salt. If the anionic surfactants are in the acid form, the calcium can be added as a calcium oxide or calcium hydroxide slurry in water to neutralise the acid.

The calcium ions may be present in the compositions as salts. The amount of calcium ions present in compositions of the invention may be dependent upon the amount of total anionic surfactant present herein.

The molar ratio of calcium ions to total anionic surfactant is preferably from 1:0.1 to 1:25, more preferably from 2:1 to 1:10, for compositions of the invention.

Magnesium

Preferably, from 0.01% to 5%, more preferably from 0.05% to 5%, even more preferably from 0.2% to 4%, most preferably from 0.5% to 3% by weight of the composition, by weight, of magnesium ions are preferably added to the liquid detergent compositions of the invention. The inclusion of magnesium provides for improved product stability.

If the anionic surfactants are in the acid form, then the magnesium can be added by neutralization of the acid with a magnesium oxide or magnesium hydroxide slurry in water. Calcium can be treated similarly. This technique minimises the addition of chloride ions, which reduces corrosive properties. The neutralized surfactant salts and the hydrotrope are then added to the final mixing tank and any optional ingredients are added before adjusting the pH.

Calcium stabilizing agent

Malic, maleic or acetic acid, or salts thereof, or certain lime soap dispersant compounds may be added to a composition formulated to contain calcium to provide good product stability, and in particular to prevent the precipitation of insoluble calcium salts. Where calcium is present, malic, maleic or acetic acid, or salts thereof, may be added at levels of from 0.05% to 10% by weight of the composition and a molar ratio with calcium of from 0.01:1 to 1:10.

Composition pH

The compositions in accord with the invention will be formulated such that the compositions have a pH in a 1% solution water at 20° C. of less than 6.0, preferably between 3.0 and 6.0, more preferably between 3.0 and 5.0, most preferably between 3.5 and 4.5.

Techniques for controlling pH at recommended usage levels include the use of buffers, alkali, acids, etc., and are well known to those skilled in the art. Dilute hydrochloric acid is preferred for downward pH adjustment, and sodium hydroxide for upward pH adjustment.

Additional Surfactant

The compositions of the invention preferably contain additional surfactant selected from nonionic, cationic, zwitterionic, ampholytic, and amphoteric surfactants, and any mixtures thereof, at a level of from 1% to 60%, preferably from 2% to 30%, most preferably from 3% to 15% by weight of the composition.

Any surfactant is preferably formulated to be compatible with any enzyme components.

Preferably the surfactant system comprises from 5% to 90% by weight, more preferably from 30% to 70% by weight of the surfactant system of anionic surfactant, and from 5% to 60% by weight, more preferably from 15% to 50% by weight of the surfactant of nonionic surfactant.

Nonionic surfactant

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, nonlimiting classes of useful nonionic surfactants are listed below.

Nonionic Polyhydroxy fatty acid amide surfactant

Polyhydroxy fatty acid amides suitable for use herein are those having the structural formula:

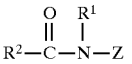

(I)

wherein: $R^1$ is H, $C_1$–$C_4$ hydrocarbyl, 2-hydroxy ethyl, 2-hydroxy propyl, or a mixture thereof, preferable $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight-chain $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose.

As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH2—OH_2$, $—CH(CH_2OH)—(CHOH)_n—$, $—CH_2OH$, $—CH_2—(CHOH)_2(CHOR')(CHOH)—CH_2OH$ where n is an integer from 3 to 5, inclusive, and R' is H or a cyclic or aliphatic monosaccharide, and alkoxylate derivative thereof. Most preferred are glycityls wherein n is 4, particularly $—CH_2—(CHOH)_4—CH_2OH$.

In Formula (I), R1 can be, for example, N-methyl, N-ethyl, N-propyl, N-isopropyl, N-butyl, N-2-hydroxy ethyl, or N-2-hydroxy propyl. R2-CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula:

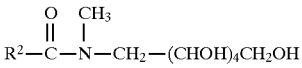

wherein $R^2$ is a straight chain $C_{11}$–$C_{17}$ alkyl or alkenyl group.

Nonionic condensates of alkyl phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 12 carbon atoms in either a straight chain or branched chain configuration with the alkylene oxide.

Nonionic ethoxylated alcohol surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from about 2 to about 10 moles of ethylene oxide per mole of alcohol. Most preferred are the condensation products of alcohols having an alkyl group containing from 10 to 14 carbon atoms with from about 6 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.54 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and KyroTM EOBN (the condensation product of $C_{13}$–$C_{15}$ alcohol with 9 moles ethylene oxide), marketed by The Procter & Gamble Company.

Nonionic EO/PO condensates with propylene glycol

The condensation products of ethylene oxide with a hydrophobic base formed by the condensation of propylene oxide with propylene glycol are suitable for use herein. Examples of compounds of this type include certain of the commercially-available Pluronic™ surfactants, marketed by BASF.

Nonionic EO condensation products with propylene oxide/ethylene diamine adducts

The condensation products of ethylene oxide with the product resulting from the reaction of propylene oxide and ethylenediamine are suitable for use herein. Examples of this type of nonionic surfactant include certain of the commercially available Tetronic™ compounds, marketed by BASF.

Nonionic alkylpolysaccharide surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galatoses. Suitable mixtures include coconut alkyl, di-, tri-, tetra-, and pentaglucosides and tallow alkyl tetra-, penta- and hexaglucosides.

The preferred alkylpolyglycosides have the formula:

$$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-,3-, 4- and/or 6-position, preferably predominantly the 2-position.

Nonionic fatty acid amide surfactant

Fatty acid amide surfactants suitable for use herein are those having the formula:

$$R^6-\overset{\overset{\displaystyle O}{\|}}{C}-N(R^7)_2$$

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Ampholytic surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants.

Amphoteric surfactant

Suitable amphoteric surfactants for use herein include the alkyl amphocarboxylic acids of the formula:

$$RC(=O)-NHCH_2CH_2Ri$$

wherein R is a $C_8$–$C_{18}$ alkyl group, and $R_i$ is of the general formula:

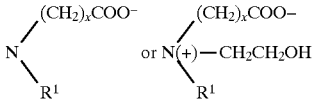

wherein $R^1$ is a $(CH_2)_xCOOM$ or $CH_2CH_2OH$, and x is 1 or 2 and M is preferably chosen from alkali metal, alkaline earth metal, ammonium, mono-, di-, and triethanolammonium, most preferably from sodium, potassium, ammonium and mixtures thereof with magnesium ions. The preferred R alkyl chain length is a $C_{10}$ to $C_{14}$ alkyl group. A preferred amphocarboxylic acid is produced from fatty imidazolines wherein the dicarboxylic acid functionality of the amphodicarboxylic acid is diacetic acid and/or dipropionic acid. A suitable example of an alkyl aphodicarboxylic acid for use herein in the amphoteric surfactant Miranol(™) C2M Conc. manufactured by Miranol, Inc., Dayton, N.J.

Amine oxide surfactant

Amine oxides useful, as amphoteric surfactants, in the present invention include those compounds having the formula:

$$R^3(OR^4)_xN(\overset{O}{\overset{|}{}}R^5)_2$$

wherein $R^3$ is selected from an alkyl, hydroxyalkyl, acylamidopropoyl and alkyl phenyl group, or mixtures thereof, containing from 8 to 26 carbon atoms, preferably 8 to 16 carbon atoms; $R^4$ is an alkylene or hydroxyalkylene group containing from 2 to 3 carbon atoms, preferably 2 carbon atoms, or mixtures thereof; x is from 0 to 3, preferably 0; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure. These amine oxide surfactants in particular include $C_{10}$–$C_{18}$ alkyl dimethyl amine oxides and $C_8$–$C_{12}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide and dimethyl-2-hydroxyoctadecylamine oxide. Preferred are $C_{10}$–$C_{18}$ alkyl dimethylamine oxide, and $C_{10-18}$ acylamido alkyl dimethylamine oxide.

Zwitterionic surfactant

Zwitterionic surfactants can also be incorporated into the detergent compositions herein. See U.S. Pat. No. 3,929,678 to Laughlin et al., issued Dec. 30, 1975 at column 19, line 38 through column 22, line 48 (herein incorporated by reference) for examples of zwitterionic surfactants.

Betaine surfactant

The betaines useful, as zwitterionic surfactants, in the present invention are those compounds having the formula $R(R')_2N^+R^2COO^-$ wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl,m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethylbetaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines.

The complex betaines suitable for use herein have the formula:

$$R-(A)_n-[\underset{\underset{B}{|}}{N}-(CHR_1)_x]_y-\underset{\underset{B}{|}}{N}-Q \qquad (I)$$

wherein R is a hydrocarbon group having from 7 to 22 carbon atoms, A is the group (C(O)), n is 0 or 1, $R_1$ is hydrogen or a lower alkyl group, x is 2 or 3, y is an integer of 0 to 4, Q is the group —$R_2$COOM wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

Sultaines

The sultaines useful in the present invention are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Organic solvent

The compositions of the invention will most preferably contain an organic solvent system present at levels of from 1% to 30% by weight, preferably from 3% to 25% by weight, more preferably form 5% to 20% by weight of the composition. The organic solvent system may be a mono, or mixed solvent system; but is preferably in mixed solvent system. Preferably, at least the major component of the solvent system is of low volatility.

Suitable organic solvent for use herein has the general formula $$RO(\overset{CH_3}{\overset{|}{CH_2CHO}})_nH.$$

wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1-n-butoxypropane-2-ol (n=1); and 1(2-n-butoxy-1-methylethoxy)propane-2-ol (n=2), and mixtures thereof.

Other solvents useful herein include the water soluble CARBITOL solvents or water-soluble CELLOSOLVE solvents. Water-soluble CARBITOL solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE solvents are compounds of the 2-alkoxyethoxy ethanol class, with 2-butoxyethoxyethanol being preferred.

Other suitable solvents are benzyl alcohol, and diols such as 2-ethyl-1,3-hexanediol and 2,2,4-trimethyl-1,3-pentanediol.

The low molecular weight, water-soluble, liquid polyethylene glycols are also suitable solvents for use herein.

The alkane mono and diols, especially the $C_1$–$C_6$ alkane mono and diols are suitable for use herein. $C_1$–$C_4$ monohydric alcohols (eg: ethanol, propanol, isopropanol, butanol and mixtures thereof) are preferred, with ethanol particularly preferred. The C1–C4 dihydric alcohols, including propylene glycol, are also preferred.

Suds-enhancing agents

The compositions of the present invention may comprise from 1% to 20%, preferably from 2% to 20% by weight of a suds enhancing agent selected from the group consisting of amine oxides, betaines, sultaines, complex betaines, and certain nonionics.

Preferred amides are $C_8$–$C_{20}$ alkyl mono- or di-$C_2$–$C_3$ alkanolamides, especially monoethanolamides, diethanolamides, and isopropanolamides.

Preferred suds enhancing agents are $C_{10-18}$ acyl amide alkyl dimethyl amine oxides, betaines, condensation products of aliphatic alcohols with ethylene oxides, and alkylpolysaccharides, and mixtures thereof.

Hydrotropes

A hydrotrope is typically added to the compositions of the present invention, and may be present at levels of from 0.5% to 10%, preferably from 1% to 5%, by weight.

Useful hydrotropes include sodium, potassium, and ammonium xylene sulfonates, sodium, potassium, and ammonium toluene sulfonate, sodium potassium and ammonium cumene sulfonate, and mixtures thereof.

Other compounds useful as hydrotropes herein include polycarboxylates. Some polycarboxylates have calcium chelating properties as well as hydrotropic properties. Particularly useful hydrotropes are alkylpolyethoxy polycarboxylate surfactants of the type as previously described herein.

An example of a commercially available alkylpolyethoxy polycarboxylate which can be employed herein is POLY-TERGENT C, Olin Corporation, Cheshire, Conn.

Another compound useful as a hydrotrope is alkyl amphodicarboxylic acid of the generic formula:

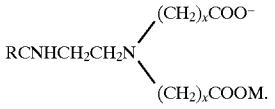

wherein R is a $C_8$ to $C_{18}$ alkyl group, x is from 1 to 2, M is preferably chosen from alkali metal, alkaline earth metal, ammonium, mono-, di-, and tri-ethanolammonium, most preferably from sodium, potassium, ammonium, and mixtures thereof with magnesium ions. The preferred alkyl chain length (R) is a $C_{10}$ to $C_{14}$ alkyl group and the dicarboxylic acid functionally is diacetic acid and/or dipropionic acid.

A suitable example of an alkyl amphodicarboxylic acid is the amphoteric surfactant Miranol R 2CM Conc.manufactured by Miranol, Inc., Dayton, N.J.

Lime Soap Dispersants

The compositions of the present invention are particularly useful when formulated to contain a lime soap dispersant compound which acts to disperse any insoluble lime soap salts which may be formed between the fatty acids produced by the lipolytic hydrolysis of fats/oils and calcium ions in the wash soluble, thereby preventing the deposition of these salts as spots or films on the articles in the wash, or as an unseemly ring around the rim of the sink. Certain lime soap dispersant compounds may also provide improved product stability particularly where the product is formulated as a liquid product containing calcium ions.

A lime soap dispersant compound herein is defined as a compound, which has a lime soap dispersing power (LSDP), as of no more than 8, preferably no more than 7, most preferably no more than 6.

The LSDP is the % weight ration of dispersing agent to sodium oleate required to disperse the lime soap deposits formed by 0.025 g of sodium oleate in 30 ml of water of 333 ppm CaCO3 (Ca:Mg=3:2) equivalent hardness.

The lime soap dispersant compound is typically present at a level of from 0.1% to 40% by weight, more preferably 1% to 20% by weight, most preferably from 2% to 10% by weight of the compositions.

Enzyme

The compositions in accordance with the invention may contain enzyme components. Suitable enzymes include those selected from lipolytic, amylolytic and proteolytic enzymes.

Enzymes herein are preferably compatible with surfactants. They are preferably stable in the present compositions and improve cleaning when they are included in the present compositions.

Proteolytic enzyme

The compositions may contain proteolytic enzyme (protease) which, where present, is preferably incorporated at a level of from 0.005% to 2% active enzyme by weight of the composition.

Commercially available protease enzymes include those sold under the tradenames Alcalase and Savinase by Novo Industries A/S (Denmark) and Maxatase by International Bio-Synthetics, Inc. (The Netherlands).

Amylolytic enzyme

Amylolytic (amylase) enzyme may be incorporated into the compositions in accordance with the invention at a preferred level, where present, of from 0.005% to 2% active enzyme by weight of the composition.

Amylases include, for example, alpha-amylases obtained from a special strain of B licheniforms, described in more detail in GB 1,269,839 (Novo). Commercially available amylases include for example, Rapidase, sold by International Bio-Synthetics Inc, and Termamyl, sold by Novo Industries A/S.

Lipolytic enzyme

The compositions may contain lipolytic enzyme (lipase) which, where present, is preferably incorporated at levels of active lipolytic enzyme of from 0.001% to 2% by weight, more preferably 0.01% to 1% by weight, most preferably from 0.05% to 0.5% by weight of the compositions.

The lipase is preferably bacterial in origin being obtained, for example, from a lipase producing strain of Humicola sp. or Thermomyces sp. or Pseudomonas pseudoalcaligenes or Pseudomas fluorescens.

Lipase from chemically or genetically modified mutants of these strains are also included herein. Mixtures of lipase from various strains are included herein, though not preferred.

A lipase derived from Pseudomonas pseudoalcaligenes is described in Granted European Patent, EP-B-0218272.

Another lipase herein is obtained by cloning the gene from Humicola lanuginosa and expressing the gene in Aspergillus oryza, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Suitable lipases include those which show a positive immunological cross-reaction with the antibody of the lipase produced by Pseudomonas flluorescens. This lipases described in Japanese Patent Application 53-20487, laid open Feb. 24, 1987. It is available under the trade name Lipase P Amano. A method for testing immunological cross-reaction with Amano P antibody is described in U.S. Pat. No. 4,707,291, Thom et al, issued Nov. 17, 1987.

A lipase unit (LU) is defined as the amound of lipase which produces 1 umol of titratable butyric acid per minute in a pH stat, where pH is 7.0, temperature is 30° C., and substrate is an emulsion of ributyrin and gum arabic in the presence of Ca++ and NaCl in phosphate buffer.

Enzyme Stabilizing System

Preferred enzyme-containing compositions herein may comprise from 0.001% to 10%, preferably from 0.005% to 8%,most preferably from 0.01% to 6%, by weight of an enzyme stabilizing system. The enzyme stabilizing system can be any stabilizing system which is compatible with the detersive enzyme. Such stabilizing systems can comprise calcium ion, boric acid, propylene,glycol, short chain carboxylic acid, boronic acid, and mixtures thereof.

The compositions herein may further comprise from 0 to 10%, preferably from 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from 0.5 ppm to 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in solid-form composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Form of the compositions

The compositions are fluid in nature, being for example liquids, gels, creams, foams or mousses.

Liquid compositions

In one preferred embodiment, the detergent compositions of the present invention are liquid detergent compositions. These preferred liquid detergent compositions typically comprise from 94% to 35% by weight, preferably from 90% to 40% by weight, most preferably from 80% to 50% by weight of a liquid carrier, e.g., water, preferably a mixture of water and organic solvent.

Gel compositions

The detergent compositions of the present invention may also be in the form of gels. Such compositions are typically formulated in polyakenyl polyether and having a molecular weight of from about 750,000 to about 4,000,000.

Highly preferred examples of these polycarboxylate polymer thickeners are the Carbopol 600 series resins available from B.F. Goodrich. Especially preferred are Carbopol 616 and 617. It is believed that these resins are more highly cross-linked than the 900 series resins and have molecular weights between about 1,000,000 and 4,000,000. Mixtures of polycarboxylate polymers as herein described may also be used in the present invention. Particularly preferred is a mixture of Carbopol 616 and 617 series resins.

The polycarboxylate polymer thickener is utilized preferably with essentially no clay thickening agent. In fact, it has been found that if the polycarboxylate polymers of the present invention are utilized with clay in the composition of the present invention, a less desirable product, in terms of phase instability, results. In other words, the polycarboxylate polymer is preferably used instead of clay as a thickening/stabilizing agent in the present compositions.

If the polycarboxylate polymer is used as a thickening agent in the compositions of the present invention, it is typically present at a level of from about 0.1% to about 10%, preferably from about 0.2% to about 2% by weight.

The thickening agents are preferably used to provide a yield value of from about 50 to about 350 and most preferably from about 75 to about 250. The yield value is an indication of the shear stress at which the gel strength is exceeded and flow is initiated. It is measured herein with a Brookfield RVT model viscometer with a T-bar B spindle at 25° utilizing a Helipath.

Other desirable ingredients typically used in the compositions herein include dyes, perfumes and opacifiers.

Opacifiers such as Lytron (Morton Thiokol, Inc.), a modified polystyrene latex, or ethylene glycol distearate can be added, preferably as a last step. Lytron can be added directly as a dispersion with mixing. Ethylene glycol distearate can be added in a molten state with rapid mixing to form pearlescent crystals. Opacifiers useful herein, particularly for light duty liquids, are typically present at levels from about 0.2% to about 10%, preferably from about 0.5% to about 6% by weight.

Manual Diswashing Method

According to the manual dishwashing method aspect of this invention, soiled dishes are contacted with an effective amount, typically from about 0.5 g to about 20 g (per 25 dishes being treated), preferably from about 3 g to about log, of the composition of the present invention. The actual amount of detergent composition used will be based on the judgement of user, and will depend upon factors such as the particular product formulation of the composition, the concentration of the composition, the number of soiled dishes to be cleaned and the degree of soiling of the dishes.

In the method aspect of the invention a concentrated solution of the detergent composition is applied to the surface of the dishes tube washed. By concentrated solution of the composition it is meant no less than a 20% by weight, preferably no less than 50% by weight product dilution, and most preferably the composition is applied in undiluted form.

Application of the detergent to the surface of the dishes can be enabled by use of an applicator such as a sponge, cloth or brush to which detergent has previously been applied, or in an alternative and preferred process the product is sprayed on to the surface of the dishes. The detergent will typically be distributed on the surface of the dishes in such a way that heavily soiled areas are more heavily dosed than those where only light soiling is present. The dishes may have been pre-rinsed or pre-soaked in water prior to application of the detergent, although this is not necessary, The concentrated solution of the detergent composition is allowed to remain on the surface of dishes for a period of time. The precise length of this time period will depend on a number of factors including degree of soiling of the dishes, amount of detergent applied, the extent of any pre-rinsing or pre-soaking in water, and the nature of any subsequent rinsing or washing steps.

Subsequently, the dishes are subjected to a manual or machine washing or rinsing method, involving either further washing steps and use of detergent product, and/or to a manual or machine rinsing method. Preferably the dishes are subjected solely to a manual or machine rinsing method.

Preferred methods in accord with the invention termed herein the "direct application method" and "detergent pre-soak method" are hereinafter more fully described.

Direct Application Method

The direct application method will typically comprise as a first step wetting the soiled dishes, by eg: immersing in a water bath without any liquid dishwashing detergent, or holding under a running tap. A device for absorbing liquid dishwashing detergent, such as a sponge, is then placed directly into a separate quantity of concentrated liquid or gel detergent composition for a period of time typically ranging from about 1 to about 5 seconds. The absorbing device, and consequently the undiluted detergent composition, is then contacted individually to the surface of each of the soiled dishes. The absorbing device is typically contacted with each dish surface for a period of time range from 1 to 10 seconds, although the actual time of application will be dependent upon factors such as the degree of soiling of the dish. The contacting of the absorbing device to the dish surface is preferably accompanied by concurrent scrubbing. Subsequently, the dishes are rinsed manually by immersion in a water bath or by passing under a stream of running water, with typically further manual agitation of the dish surface.

Detergent Pre-soak Method

In the detergent pre-soak method herein, the concentrated solution of detergent is applied to the surface of the dishes by any of the aforementioned means, and is allowed to remain on the dishes for an extended period of time of from 30 seconds to 24 hours, more typically from 5 minutes to 1 hour, preferably from 10 minutes to 30 minutes. The dishes are subsequently subjected to a manual or machine dishwashing or rinsing method, preferably a rinsing method.

Where the subsequent dishwashing or rinsing method utilizes a dishwashing machine it is preferred that the composition used in the detergent pre-soak method contains suds suppressor at a level of from 0.01% to 15% by weight. The suds suppressor may be any of these commonly known in the art including known silicone and fatty acid suds suppressors.

EXAMPLES

The following compositions were prepared. Compositions I–III are in accord with the invention, compositions IV and V are prior art compositions.

| | % by weight | | | | |
|---|---|---|---|---|---|
| | I | II | III | IV | V |
| C12/13 alkyl ethoxy (ave. 0.8) sulphate | 27.0 | 27.0 | 27.0 | 27.0 | 19.0 |
| C12/14 alkyl amine oxide | 2.7 | 2.7 | 2.7 | 2.7 | 1.0 |
| C12/14 betaine | — | — | — | — | 1.0 |
| C12 alkyl N-methyl glucamide | — | — | — | — | 7.0 |

-continued

| | % by weight | | | | |
|---|---|---|---|---|---|
| | I | II | III | IV | V |
| C10 Alkyl Ethoxylate (ave. 8) | — | — | — | — | 5.0 |
| Polypropylene glycol | 10.0 | — | — | — | 0.8 |
| Diethylene glycol monbutyl ether | — | — | 10.0 | — | — |
| Ethanol | 5.0 | 15.0 | 5.0 | 15.0 | 5.6 |
| $Mg^{++}$ ion | 2.0 | 0.8 | 2.0 | 0.7 | 0.3 |
| Sodium xylene sulfonate | — | — | — | 2.0 | — |
| Sodium cumene sulfonate | 2.0 | 2.0 | 2.0 | — | 1.5 |
| Water/misc to balance | | | | | |
| pH | 4.0 | 4.0 | 4.0 | 7.0 | 7.3 |

The compositions were prepared by mixing all of the surfactants with the exception of any glucamide. The magnesium salts were then pre-dissolved into solution added to the surfactant mixture with the remaining components. Finally the pH was trimmed and the viscosity checked.

The greasy soil removal performance of the five compositions, I–V, was compared in a test method related to the Detergent Pre-soak Method for full scale hand dishwashing as follows:

Five soiled plastic slides were prepared by taking five preweighed clean 6.5 cm×5 cm plastic slides, applying approximately 2 g of greasy soil (9:1 mixture of vegetable oil, corn oil) to each slide, and placing the slides in a fridge overnight. Each slide was then weighed, to obtain the exact mass of soil applied, and placed in a separate Petri dish. One of the compositions I–V was then added to each soiled slide-containing Petri dish, such that the soiled slide was fully immersed in the detergent. Each slide was allowed to remain so immersed for 15 minutes, before being removed from the Petri dish and clipped, using a bulldog clip, onto a bar which was suspended between two retort stands, at a height of 28 cm above the bench. Each suspended slide was then sprayed for 20 seconds with a uniform spray of water, originating from a 'garden spray' positioned 50 cm from the slide. Each slide was then dried, by placing in an oven at 40° C., and reweighed to calculate the mass of soil removed by the soaking/rinsing process. The full test procedure was repeated four times for each test composition. The average mass of soil removed for each composition was indexed to a standard reference, taken to be the mass of soil removed for composition IV.

The following grease removal indices were obtained:

| Composition | Greasy soil removal index |
|---|---|
| I | 370 |
| II | 208 |
| III | 220 |
| IV | 100 |
| V | 50 |

What is claimed is:

1. A fluid detergent composition, suitable for use in a dishwashing method in which the detergent composition is applied to the dishes in essentially concentrated form, consisting essentially of:

(a) from 1% to 80% by weight of the composition of anionic surfactant; and (b) from 0.05% to 10% by weight of the composition of divalent ion, selected from the group consisting of magnesium ions, calcium ions mixtures thereof; and (c) from 0.01% to 15% by weight of the composition of suds suppressor and (d) an enzyme;

wherein said composition is formulated such that the pH of a 1% solution of the composition in water, at 20° C., is between 3.5 and 4.5.

2. A composition according to claim 1 wherein said composition is in the form of a liquid or gel.

3. A composition according to claim 1 wherein said composition contains organic solvent at a level of from 1% to 30% by weight of the composition.

4. A composition according to claim 1 wherein said composition contains no builder salts.

5. A composition according to claim 1 wherein said composition contains no bleaching components.

6. A composition according to claim 1, comprising from 1% to 80% by weight of additional surfactant selected from the group consisting of nonionic, cationic, zwitterionic, ampholytic and amphoteric surfactants.

7. A composition according to claim 1 wherein the pH of 1% by weight solution of said composition is from 3.0 to 5.0.

8. A composition according to claim 1 containing from 0.05% to 5% by weight of calcium ions.

9. A composition according to claim 1 containing from 0.01% to 5% by weight of magnesium ions.

10. A method for washing dishes wherein an effective amount of a concentrated solution of any of the compositions according to claim 1 is applied to the surface of the dishes.

11. A method according to claim 10 wherein said concentrated solution is allowed to remain on the surface of the dishes for from 5 minutes to 1 hour.

12. A method according to claim 10 wherein said dishes are subjected to subsequent rinsing steps.

13. A method according to claim 11 wherein said dishes are subjected to subsequent rinsing steps.

14. A detergent composition according to claim 1, further comprising an enzyme selected from the group consisting of lipolytic enzymes, amylolytic enzymes, proteolytic enzymes and mixtures thereof.

15. A fluid detergent composition, suitable for use in a dishwashing method in which the detergent composition is applied to the dishes in essentially concentrated form consisting essentially of by weight:

(a) from 5% to 40% anionic surfactant;

(b) from 0.5% to 3% magnesium ions;

(c) 2% to 20% amine oxide;

(d) 3% to 25% organic solvent;

(e) 0.5% to 10% hydrotrope and (f) an enzyme;

wherein said composition is formulated such that the pH of a 1% solution of the composition in water, at 20° C., is between 3.5 and 4.5.

16. A dishwashing detergent composition, consisting essentially of:

(a) from 1% to 80%, by weight, anionic surfactant;

(b) from 0.05% to 10%, by weight, divalent ion selected from the group consisting of magnesium ions, calcium ions and mixtures thereof; and (c) enzyme;

wherein the pH of a 1% solution of the composition in water, at 20° C., is no more than 6; and wherein the enzyme is selected from the group consisting of lipolytic enzymes, amylolytic enzymes, proteolytic enzymes and mixtures thereof.

17. A dishwashing detergent composition according to claim 16, further comprising from 0.001% to 10%, by weight, of an enzyme stabilizing system comprising an ingredient selected from the group consisting of boric acid, boronic acid and mixtures thereof.

18. A dishwashing detergent composition according to claim 17, wherein the pH of a 1% solution of the composition in water at 20° C. is between 3.5 and 4.5.

* * * * *